US007866855B2

(12) United States Patent
Abdelsamed

(10) Patent No.: US 7,866,855 B2
(45) Date of Patent: Jan. 11, 2011

(54) LUMINAIRE REFLECTOR HAVING IMPROVED PRISM TRANSITION

(75) Inventor: Yaser S. Abdelsamed, Granville, OH (US)

(73) Assignee: ABL IP Holding LLC., Conyers, GA (US)

( * ) Notice: Subject to any disclaimer, the term of this patent is extended or adjusted under 35 U.S.C. 154(b) by 0 days.

(21) Appl. No.: 10/593,953

(22) PCT Filed: Dec. 2, 2005

(86) PCT No.: PCT/US2005/043592

§ 371 (c)(1),
(2), (4) Date: Sep. 22, 2006

(87) PCT Pub. No.: WO2006/060642

PCT Pub. Date: Jun. 8, 2006

(65) Prior Publication Data

US 2007/0165411 A1 Jul. 19, 2007

Related U.S. Application Data

(60) Provisional application No. 60/632,689, filed on Dec. 3, 2004.

(51) Int. Cl.
*F21V 5/00* (2006.01)
*F21V 7/00* (2006.01)

(52) U.S. Cl. ..... 362/338; 362/327; 362/334; 362/335; 362/336; 362/337; 362/339; 362/340; 362/297; 362/346; 362/347; 362/350

(58) Field of Classification Search ..... 362/327, 362/334–340, 297, 346–347, 350
See application file for complete search history.

(56) References Cited

U.S. PATENT DOCUMENTS

| | | | | |
|---|---|---|---|---|
| 1,259,493 | A | 3/1918 | Dorey | |
| 3,329,812 | A | 7/1967 | Harling | |
| 4,839,781 | A | 6/1989 | Barnes et al. | |
| 4,903,180 | A | 2/1990 | Taylor et al. | |
| 5,444,606 | A | 8/1995 | Barnes | |
| D388,526 | S | 12/1997 | Bray | |
| 6,910,785 | B2 * | 6/2005 | Sales | 362/333 |
| 2004/0141324 | A1 * | 7/2004 | Sales | 362/333 |
| 2004/0218392 | A1 * | 11/2004 | Leadford | 362/309 |

FOREIGN PATENT DOCUMENTS

| | | |
|---|---|---|
| GB | 249 046 | 3/1926 |

* cited by examiner

*Primary Examiner*—Sandra L O Shea
*Assistant Examiner*—Sean P Gramling
(74) *Attorney, Agent, or Firm*—Clark & Brody

(57) ABSTRACT

A reflector (14) for a luminaire comprises a generally parabolic wall (28) having series of main right-angled prisms (16) and an interleaved series of transition prisms (18). The main and transition prisms have essentially the same shapes and follow the same overall curvature to control the illumination. The transition prisms transition into the main prisms by merging a peak of a transition prism into the valley between adjacent main prisms in a short transition zone (20). Thus, the transition zone has only a small effect on the overall lighting pattern.

10 Claims, 3 Drawing Sheets

LUMINAIRE REFLECTOR HAVING IMPROVED PRISM TRANSITION

This application is the national stage of International Application Number PCT/US2005/043592, filed Dec. 2, 2005, which was published in English, and claims priority of U.S. Provisional Application No. 60/632,689, filed Dec. 3, 2004.

TECHNICAL FIELD

This invention relates to the art of luminaries. In particular the invention relates to the art of reflectors for luminaries formed of a series of prisms that provide total internal reflection.

BACKGROUND ART

Luminaries are known that comprise a series of generally vertical, right-angle prisms for reflecting light from a centrally located lamp. The reflectors for these luminaries are made with transparent material (glass, acrylic, etc.) and typically have sets of longitudinal prisms running from top to bottom. The reflector typically has a desired overall contour provided by the series of prisms. In most cases the desired overall contour is dome-like, with an upper part of smaller diameter and a lower part of larger diameter. This configuration results in the requirement that the prisms become gradually broader toward the lower part of the luminaire. If all of the prisms around the circumference of the reflector ran the full length of the reflector, the prisms would be very large at the largest circumference and very small at the smallest circumference. The requirement that the prisms become broader means that the thickness of the wall of the luminaire must increase toward the larger circumference, which increases the cost and weight of the luminaire.

To make the prism sizes manageable, it is known to provide two or more sets of prisms. One set of prisms, referred to herein as main prisms, runs the entire length, while the other set or sets, referred to herein as transition prisms, begins at the larger circumference and transitions out along the reflector. By this arrangement, fewer prisms are provided at the smaller circumference, and the uniformity of the prism sizes is improved.

A problem presented by this arrangement is that the contours of the main prisms (i.e., those that extend along the entire arc length of the reflector) and of the transition prisms (i.e., those that taper out along the length) differ by the degree of taper incorporated into the transition prisms. The resulting reflector geometry is, therefore, a combination of the two, or more, geometries of the sets of prisms, and the resulting light pattern is the net sum of the light patterns generated by the distinct reflector geometries. A known luminaire having such a reflector is shown in U.S. Pat. No. 4,839,781.

Thus, the design of the reflector to achieve a desired light pattern requires tradeoffs in the different geometries. For example, this configuration may require the main beam to be higher than needed to compensate for a transition beam lower than needed to achieve a beam at the actual desired angle.

SUMMARY OF THE INVENTION

In accordance with the invention, a reflector for a luminaire having a plurality of longitudinal prisms is constructed such that the geometry of a main prism is the same as the predominate geometry of a transition prism. This arrangement allows greater control over the light pattern because the trade offs of the prior art are obviated.

According to the new configuration, the transition prisms are arranged such that they have the same configuration as the main prisms over the majority of the length of the main prisms (i.e., the length of the reflector) and then merge into the main prisms quickly. This configuration may be visualized as comprising transition prisms that are essentially identical to the main prisms over the major part of the reflector, with the peaks of the transition prisms aligned with the valleys of the main prisms. In the transition zone, the peak of each transition prism merges quickly into a respective valley of a main prism. For example, the radius of curvature of the peak of the transition prism in the transition zone may be 2-4 inches such that the transition zone is very short. In a preferred embodiment, where the overall length of the reflector is about 11 inches, the radius of curvature of the peak of the transition prism is 3 inches, the transition zone begins at about 7.5 inches from the bottom of the reflector, and the length of the transition zone is about one inch.

An object of this invention is to provide an improved prism-type reflector for a luminaire having a short transition zone.

Another object of this invention is to provide an improved prism-type reflector for a luminaire having two or more sets of prism reflectors having essentially identical geometries.

DETAILED DESCRIPTION OF THE PREFERRED EMBODIMENTS

Figure 1:
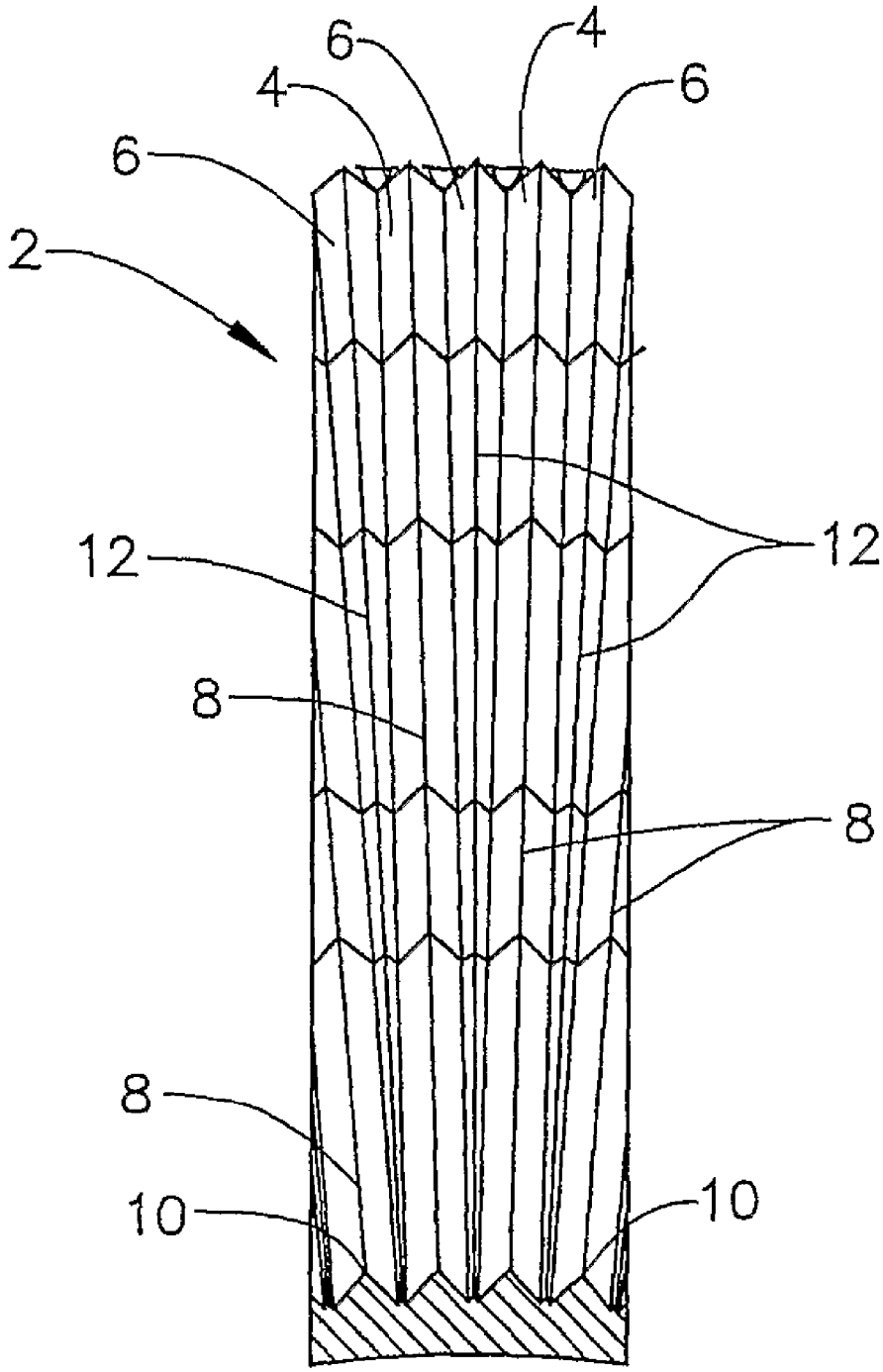
FIG. 1 PRIOR ART
FIG. 1 is a perspective of a portion of a prior-art reflector.

With reference to FIG. 1, a section 2 of a prior art reflector is shown to illustrate a known technique for providing transition prisms. In the prior arrangement, the reflector includes a series of longitudinally extending main prisms 4 and a series of transition prisms 6. The series of main prisms and the series of transition prisms are interleaved whereby there are more prisms in the region of the reflector having a larger circumference.

It will be seen from FIG. 1 that each main prism 4 has a peak 8 and a valley 10. It will further be appreciated that each of the transition prisms has a peak 12 that gradually merges into the valley 10. As shown in FIG. 1, in the usual configuration the peaks 12 of the transition prisms merge into the valleys 10 gradually over the overall height of the reflector. This means that the curvature of the peaks 12 of the transition prisms differs from the curvature of the peaks 8 of the main prisms. In essence, the peaks 12 are tilted inward toward the valleys 10, which reflect the light incident on those prisms into an area different from that into which the main prisms reflect light.

Figure 2:
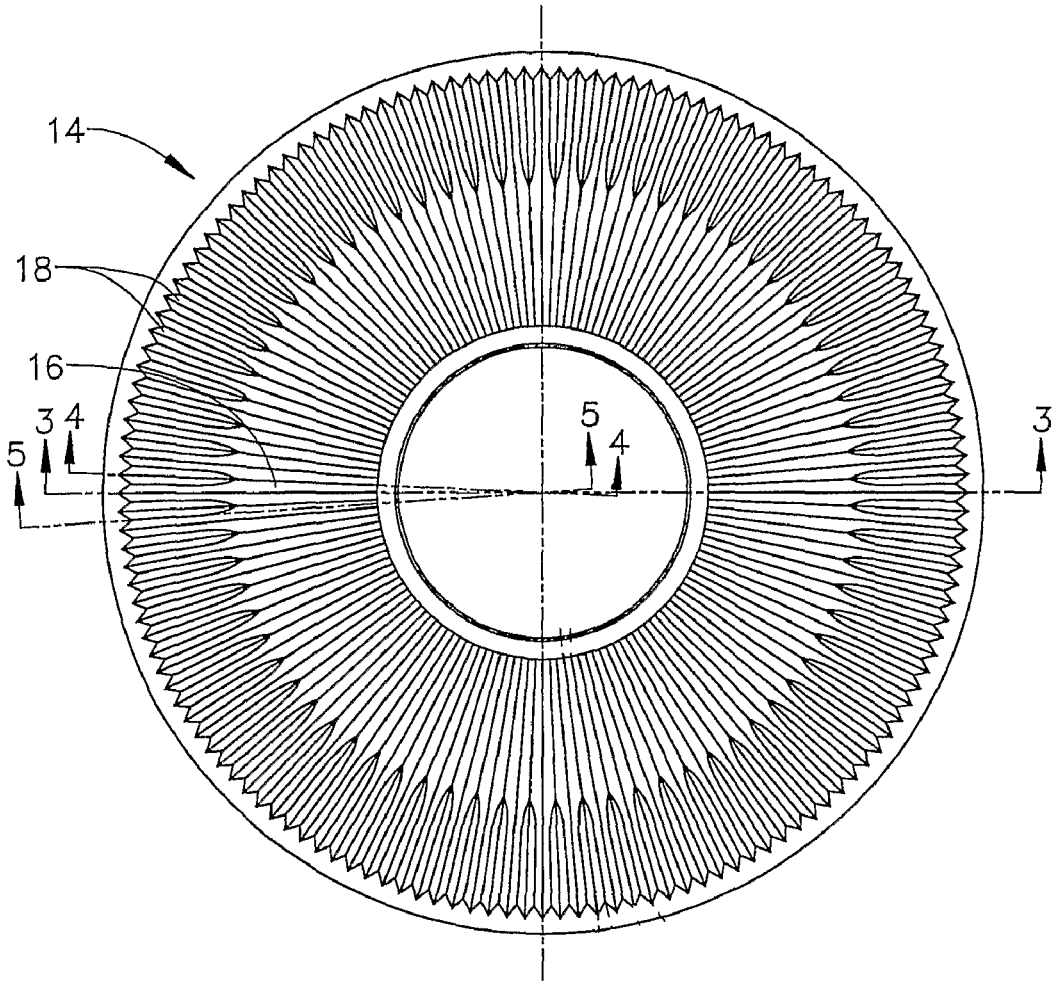
FIG. 2 is a top plan view of a reflector in accordance with the invention.
Figure 3:
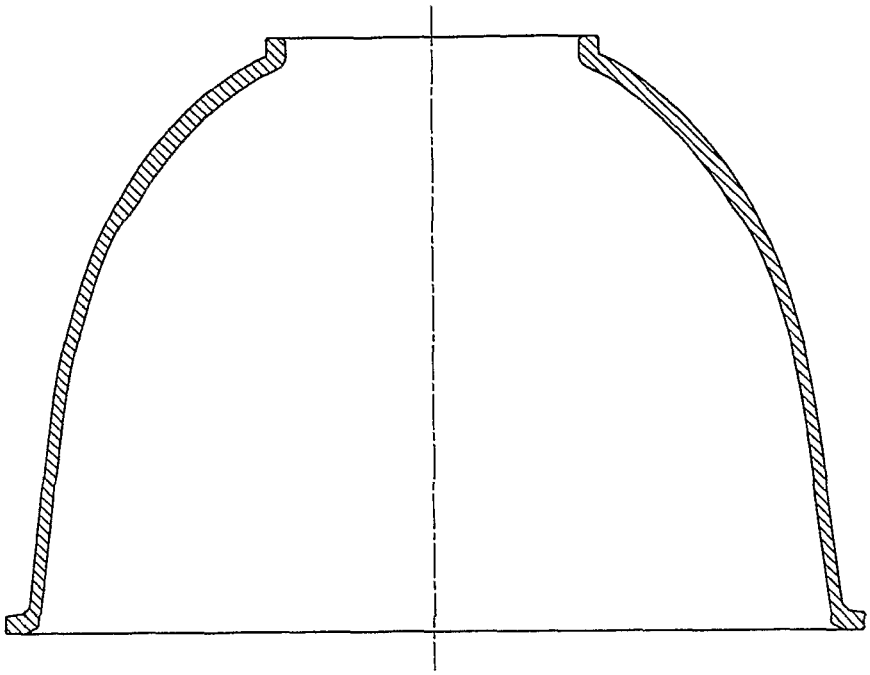
FIG. 3 is a cross section taken along line 3-3 of FIG. 2.

With reference to FIG. 2, a reflector 14 in accordance with the invention includes a plurality of main prism reflectors 16. The dome-like overall curvature is shown in FIG. 3, which is a cross section through the peaks of the main prisms. In a preferred embodiment, there are 72 identical main prisms circumferentially arranged to form about the reflector 14. Of course, that number may be increased or decreased, and the prisms do not necessarily have to be identical depending on the light pattern to be obtained.

The reflector 14 also includes a number of transition prisms circumferentially arranged about the reflector. These transition prisms are interleaved with the main prisms such that they fill in the valleys of the main prisms and then transition into the valleys. It is this transition that forms a primary feature of this invention. In the preferred embodiment there are also 72 transition prisms.

Figure 4:
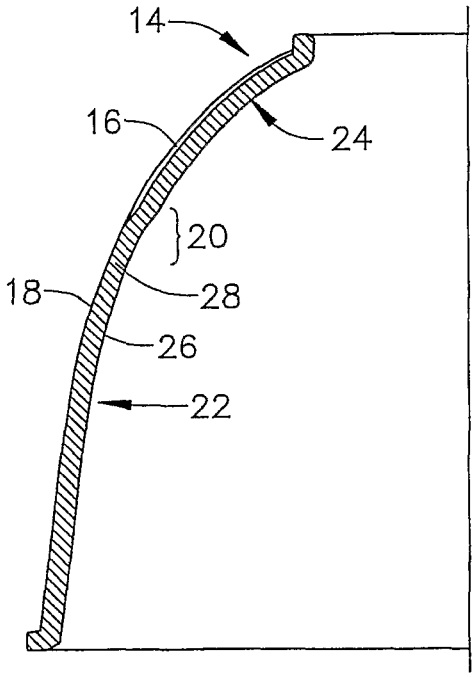
FIG. 4 is a cross section taken along line 4-4 of FIG. 2.

With reference to FIG. 4, which is a cross section taken along line 4-4 of FIG. 2 through the peak of a transition prism and the valley of a main prism. It will be seen that the transition prisms extend over a major part of the length of the reflector. Furthermore, the curvatures of the transition prisms 18 are the same as those of the main prisms 16 over all but a small part of the length of the transition prism. That is the transition region 20 is made short to reduce significantly the optical effect of the geometry required by the transition. In the preferred embodiment, the transition zone is circular in vertical cross section with a radius of curvature of about 3 inches; its length is about one inch. The shape of the transition zone may vary from that of a circle and may be linear, parabolic, stepped or other shapes.

Reducing the size of the transition zone has been found to significantly reduce its effect whereby the resulting lighting pattern more closely matches the design intent. It will be appreciated that the transition zone should be as small as possible given manufacturing realities so as to provide the minimum flux capture from that zone. In some instances it may be possible to eliminate the transition zone by starting the transition prisms immediately at the desired location. This would result in the transition zone being essentially a step. In the preferred embodiment, the length of the transition zone is less than about ten percent of the length of the reflector and preferably less than five percent.

It will be appreciated that the thickness of the wall of the reflector in the region 22 below the transition zone 20 is less than the thickness of the wall in the regions 24 above the transition zone. This is accomplished by matching the contour of the inner surface 26 of the sidewall 28 of the reflector to the contour of the valleys of the main prisms 16 above the transition and to the valleys of the transition prisms 18 below the transition.

Figure 5:
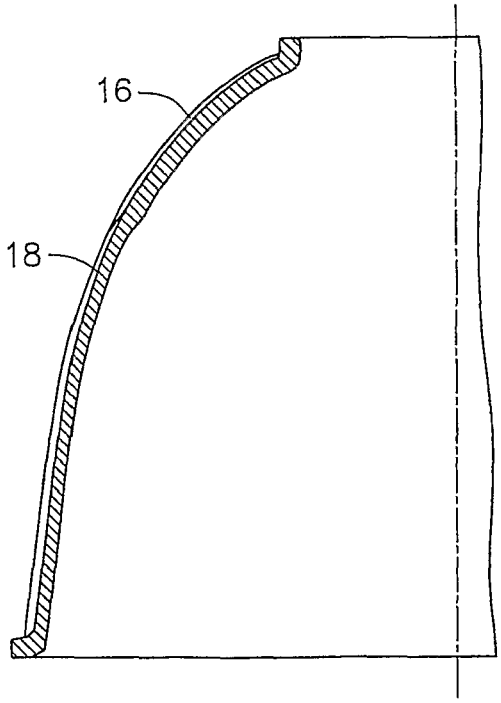
FIG. 5 is a cross section taken along line 5-5 of FIG. 2.

FIG. 5 is a cross section taken along line 5-5 of FIG. 2. This cross section is taken along a line that passes through the valley of a transition prism 18 and just below the peak of a main prism 16. This figure, thus, shows how the valley of the transition prism merges, or transitions, into the valley of the main prism. In top view, the locus of points of intersection between the valleys on opposite sides of a transition prism and the sidewalls of the adjacent main prisms form curved lines that intersect at the valley between two main prisms and appear as "pencil points" in FIG. 2.

Manufacture of a reflector according to the preferred embodiment of the invention proceeds by modification of known techniques. For example, a typical reflector is manufactured by first cutting the prisms into a metal mold and then pouring molten glass or plastic into the mold. The prisms in the mold are the inverse of the prisms in the reflector and are cut into the metal mold by cutter tools having tips formed by right angled cutting surfaces. The movement of the cutter tools is controlled by a computer programmed to cut the grooves to the desired overall configuration. Thus, to manufacture a reflector according to the invention, the computer may direct the cutter to first cut the grooves for the main prisms. Then, the cutter is maneuvered to cut the transition prisms. The tip of the cutter cuts the peak of a reflecting prism, and when the cutter reaches the beginning of the transition zone, it is controlled to follow the prescribed curve (e.g., a circle of 3-inch radius) to meet with the surface of the mold that forms the inner surface of the reflector.

Modifications within the scope of the appended claims will be apparent to those of skill in the art.

I claim:

1. A reflector for a luminaire comprising a shaped wall having a plurality of longitudinal main reflecting prisms circumferentially arranged on said shaped wall in a dome-like configuration and extending substantially the height of said shaped wall, each of said main reflecting prisms having a peak with a predetermined curvature in a cross section passing through a longitudinal axis of said shaped wall and positioned between two valleys to provide a light reflection pattern, and a plurality of transition reflecting prisms interleaved with said main reflecting prisms, each of said transition reflecting prisms having a peak between two valleys with substantially said predetermined curvature in a first region of said reflector comprising a major part of said shaped wall to provide said light reflection pattern, the peak of each transition prism transitioning into the valley of a respective main prism in a second region of said reflector forming a transition zone that is shorter than said first region, and said main reflecting prisms also forming a third region of said reflector without interleaved transition prisms.

2. A reflector according to claim 1 wherein said main reflecting prisms and said transition prisms are configured to provide internal reflection of light emanating from an interior portion of said luminaire.

3. A reflector according to claim 1 wherein the shapes of said transition reflecting prisms outside of said transition zone are essentially the same as the shapes of said main reflecting prisms.

4. A reflector according to claim 1 wherein said shaped wall is rotationally symmetric about a longitudinal axis of said luminaire.

5. A reflector according to claim 1 wherein the length of said transition zone is less than about ten percent of the length of said shaped wall.

6. A reflector according to claim 1 wherein the length of said transition zone is less than about five percent of the length of said shaped wall.

7. A reflector according to claim 1 wherein said transition zone comprises a step.

8. A reflector according to claim 1 wherein in a cross section passing though a longitudinal axis of said shaped wall, the shape of said transition zone is one of linear, parabolic, or stepped.

9. A reflector according to claim 1 wherein in a cross section passing though a longitudinal axis of said shaped wall, the shape of said transition zone is circular.

10. A reflector according to claim 9 wherein the radius of curvature of said transition zone is about three inches.

* * * * *